US007387072B2

(12) United States Patent
Hunn et al.

(10) Patent No.: US 7,387,072 B2
(45) Date of Patent: Jun. 17, 2008

(54) PULSED FLUID JET APPARATUS AND MUNITION SYSTEM INCORPORATING SAME

(75) Inventors: David L. Hunn, Kennedale, TX (US); Ben T. Milam, Mansfield, TX (US); Kenneth W. Havens, Arlington, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 294 days.

(21) Appl. No.: 11/128,580

(22) Filed: May 13, 2005

(65) Prior Publication Data

US 2006/0254452 A1 Nov. 16, 2006

(51) Int. Cl.
*F41A 9/00* (2006.01)

(52) U.S. Cl. ..... 102/481; 60/223; 83/177; 102/367

(58) Field of Classification Search ..... 102/481, 102/498, 499, 529, 282, 202.5, 202.6, 368, 102/370, 204; 451/36, 38; 60/223
See application file for complete search history.

(56) References Cited

U.S. PATENT DOCUMENTS

| | | | | |
|---|---|---|---|---|
| 3,084,506 | A * | 4/1963 | Rabardy et al. | 60/223 |
| 3,357,190 | A | 12/1967 | Cassidy et al. | 60/256 |
| 3,366,055 | A | 1/1968 | Hollander, Jr. | 102/28 |
| 4,172,421 | A * | 10/1979 | Regalbuto | 102/318 |
| 4,497,251 | A | 2/1985 | Rucker | 102/202.6 |
| 4,620,591 | A * | 11/1986 | Terrell et al. | 166/63 |
| 4,690,061 | A * | 9/1987 | Armer et al. | 102/401 |
| 5,184,434 | A | 2/1993 | Hollinger et al. | 51/317 |
| 6,076,468 | A * | 6/2000 | DiGiacomo et al. | 102/530 |
| 6,080,907 | A | 6/2000 | Miller | 588/202 |
| 6,360,526 | B2 * | 3/2002 | Kunstmann | 60/223 |
| 6,702,009 | B1 * | 3/2004 | Drury et al. | 166/55 |
| 6,871,594 | B1 * | 3/2005 | Estrella | 102/498 |
| 2004/0089450 | A1 | 5/2004 | Slade et al. | 166/298 |
| 2004/0112241 | A1 | 6/2004 | Alford | 102/364 |
| 2005/0150665 | A1 * | 7/2005 | Wierenga et al. | 169/85 |

FOREIGN PATENT DOCUMENTS

| | | |
|---|---|---|
| EP | 0178039 A | 4/1986 |
| WO | WO 2004/005838 | 1/2004 |
| WO | WO 2004/106841 | 12/2004 |

* cited by examiner

*Primary Examiner*—Michael J. Carone
*Assistant Examiner*—Benjamin P Lee
(74) *Attorney, Agent, or Firm*—Daren C. Davis; James E. Walton

(57) ABSTRACT

A fluid jet apparatus includes a housing defining a propellant cavity, a fluid cavity, and a passage through the housing in fluid communication with the fluid cavity. The apparatus further includes a membrane separating the propellant cavity and the fluid cavity, a propellant disposed in the propellant cavity, and a fluid retained in the fluid cavity. The propellant urges the fluid from the fluid cavity through the passage upon initiation of the propellant. A munition system includes a munition and at least one fluid jet apparatus adapted to vent the munition. A method includes initiating a propellant to produce a rapidly expanding gas and urging a fluid through a passageway with the gas to produce a fluid jet.

19 Claims, 7 Drawing Sheets

PULSED FLUID JET APPARATUS AND MUNITION SYSTEM INCORPORATING SAME

BACKGROUND

1. Field of the Invention

The present invention relates to an apparatus for generating a fluid jet and a system for venting a container incorporating the apparatus. In particular, the present invention relates to an apparatus for generating a pulsed jet of fluid upon initiation of a propellant and a venting system incorporating the apparatus.

2. Description of Related Art

Energetic materials, such as explosives and propellants, are often found in confined spaces, for example, within munitions. Under normal conditions, these materials are unlikely to explode or burn spontaneously; however, many are sensitive to heat and mechanical shock. For example, when exposed to extreme heat (as from a fire) or when impacted by bullets or fragments from other munitions, the energetic materials may be initiated, causing the munitions, in which the energetic materials are disposed, to inadvertently explode prematurely. Conventionally, armor is used to protect munitions and other energetic material-containing devices from being impacted by bullets, fragments, or other such projectiles. Armor is, however, heavy by nature and may not be suitable for some implementations, such as in mobile containers for munitions.

Efforts have been made to develop "insensitive munitions," which are munitions that are generally incapable of detonation except in their intended missions to destroy a target. In other words, if fragments from an explosion strike an insensitive munition, if a bullet impacts the munition, or if the munition is in close proximity to a target that is hit, it is less likely that the munition will detonate. Similarly, if the munition is exposed to extreme temperatures, as from a fire, the munition will likely only burn, rather than explode.

One way that munitions have been made more insensitive is by developing new explosives and propellants that are less likely to be initiated by heating and/or inadvertent impact. Such materials, however, are typically less energetic and, thus, may be less capable of performing their intended task. For example, a less energetic explosive may be less capable of destroying a desired target than a more energetic explosive. As another example, a less energetic propellant may produce less thrust than a more energetic propellant, thus reducing the speed and/or the range of the munition. Additionally, the cost to verify and/or qualify new explosives and/or propellants, from inception through arena and system-level testing, can be substantial when compared to improving the insensitive munition compliance of existing explosives and/or propellants.

Another way to make a munition more insensitive is to rapidly vent the container in which the explosive or propellant is stored, so that pressure cannot build up when the munition is exposed to an unplanned external stimulant, such as a fire, a bullet impact or a fragment impact. If pressure is not allowed to build up, the energetic material will burn rather than detonate. Accordingly, a system has been developed that uses a cutting charge, such as a linear shaped charge, to selectively vent a container in which an energetic material is disposed. Such systems, however, may not be suitable for use with highly energetic materials because temperatures associated with the cutting charges may be sufficient to detonate the energetic material disposed in the container.

While there are many ways known in the art to render munitions more insensitive, considerable room for improvement remains. The present invention is directed to overcoming, or at least reducing, the effects of one or more of the problems set forth above.

SUMMARY OF THE INVENTION

In one aspect of the present invention, a fluid jet apparatus is provided. The fluid jet apparatus includes a housing defining a propellant cavity, a fluid cavity, and a passage through the housing in fluid communication with the fluid cavity. The apparatus further includes a membrane separating the propellant cavity and the fluid cavity, a propellant disposed in the propellant cavity, and a fluid retained in the fluid cavity. The propellant urges the fluid from the fluid cavity through the passage upon initiation of the propellant.

In another aspect of the present invention, a munition system is provided. The munition system includes a munition and at least one fluid jet apparatus adapted to vent the munition. The at least one fluid jet apparatus includes a housing defining a propellant cavity, a fluid cavity, and a passage through the housing in fluid communication with the fluid cavity. The at least one fluid jet apparatus further includes a membrane separating the propellant cavity and the fluid cavity, a propellant disposed in the propellant cavity, and a fluid retained in the fluid cavity. The propellant urges the fluid from the fluid cavity through the passage upon initiation of the propellant.

In yet another aspect of the present invention, a method is provided. The method includes initiating a propellant to produce a rapidly expanding gas and urging a fluid through a passageway with the gas to produce a fluid jet.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1A:
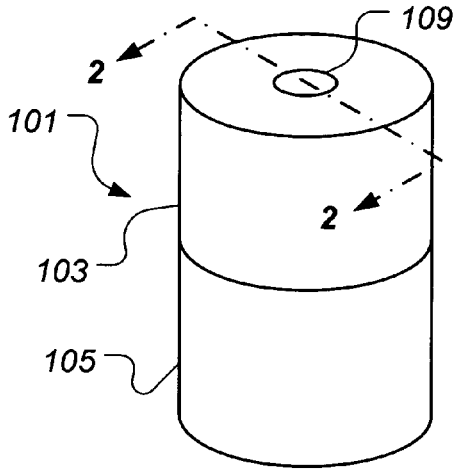
FIGS. 1A and 1B are stylized, perspective views of one particular embodiment of a fluid jet apparatus according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an apparatus for producing a jet of fluid upon initiation of a propellant. In various implementations, the apparatus is used to vent a case or other container, which may house an energetic material. For example, the apparatus may be thermally initiated to produce a high pressure pulse jet of fluid to cut or perforate a container in which a propellant or explosive is disposed so that a burning reaction, rather than a detonation reaction, occurs.

Figure 1B:
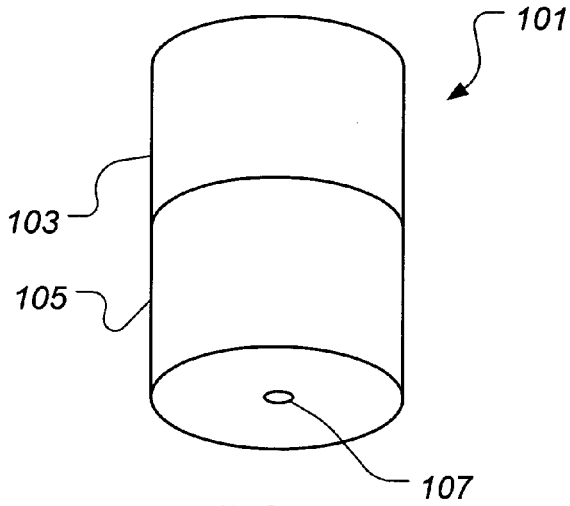

FIGS. 1A and 1B depict an illustrative embodiment of a fluid jet apparatus 101 according to the present invention. In this embodiment, fluid jet apparatus 101 includes an upper housing 103 engaged with or attached to a lower housing 105. Note that fluid jet apparatus 101 may, in various embodiments, incorporate a single, unitary housing or any suitable number of housings. Further, fluid jet apparatus 101 is illustrated herein as being generally cylindrical in form; however, the form of fluid jet apparatus 101 may be implementation specific. Thus, fluid jet apparatus 101 may take on any suitable form.

Figure 1C:
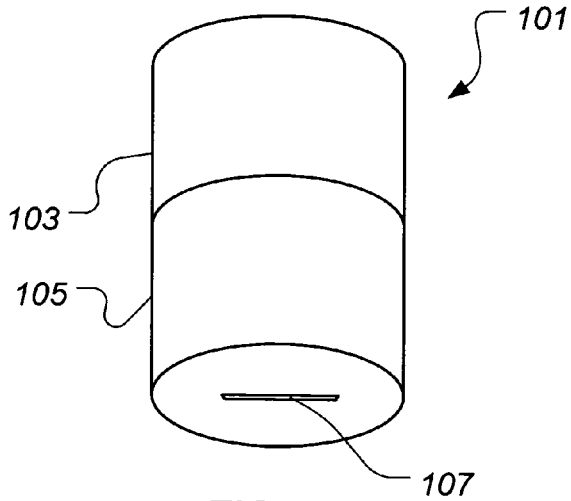
FIG. 1C is a stylized, perspective view of an illustrative embodiment alternative to that of FIGS. 1A and 1B including a slot-shaped outlet passage.

Generally, fluid jet apparatus 101 defines an outlet passage 107 through which a fluid jet is projected upon activation of apparatus 101. In the embodiment illustrated in FIG. 1B, outlet passage 107 is generally right cylindrical in shape (i.e., circular in cross-section), although many other shapes are possible within the scope of the present invention. For example, as shown in FIG. 1C, outlet passage 107 may be a slot. Other implementations of outlet passage 107 are possible and within the scope of the present invention. For example, outlet passage 107 may include a plurality of orifices or slots. Moreover, the plurality of orifices or slots may be defined by rotating elements of fluid jet apparatus 101. The shape of outlet passage 107 may vary depending upon the particular implementation of fluid jet apparatus 101, as will be more fully discussed below.

Figure 2:
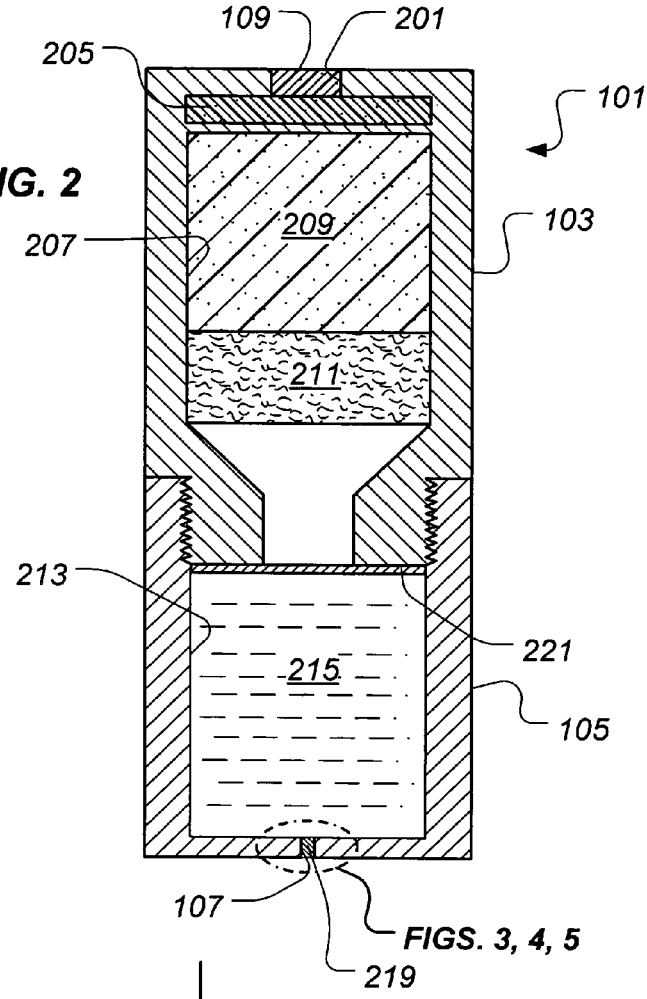
FIG. 2 is a cross-sectional view of the fluid jet apparatus of FIG. 1A taken along the line 2-2 in FIG. 1A.

FIG. 2 provides a cross-sectional view of the illustrative embodiment shown in FIGS. 1A and 1B of fluid jet apparatus 101 taken along the line 2-2 in FIG. 1A. Upper housing 103 defines a first cavity 201 in which a thermal initiator 109 (first shown in FIG. 1A) and a booster 205 are disposed. Upper housing 103 further defines a second cavity 207 in which a propellant 209 and a packing 211 are disposed. Thermal initiator 109 comprises an energetic material that deflagrates or detonates at a desired temperature or within a desired range of temperatures. For the purpose of this disclosure, an energetic material is defined as a material that, when subjected to a given amount of stimulating energy, reacts by producing a great deal more energy. The term "deflagration" means "an explosive reaction in which the reaction rate is less than the speed of sound in the reacting material." Deflagration differs from burning in that, during deflagration, the reacting material itself supplies oxygen required for the reaction. In burning, oxygen is provided from another source, such as from the atmosphere. Further, the term "detonation" means "an explosive reaction in which the reaction rate is greater than the speed of sound in the reacting material."

In the illustrated embodiment, thermal initiator 109 comprises a combination of a rapid deflagrating material and a material that, as it reacts, exhibits an increasing reaction rate, causing the reaction to propagate until the material is consumed. Examples of materials for thermal initiator 109 include, but are not limited to, $CS_2B_{12}H_{12}/BKNO_3$, lead azide, hexanitrostilbene (HNS), and ammonium perchlorate. Other energetic materials, however, may be used for thermal initiator 109.

Generally, booster 205 comprises a material that is more energetic than that of thermal initiator 109. Upon initiation, booster 205 provides sufficient energy to initiate propellant 209. Examples of materials suitable for booster 205 include, but are not limited to, $Cs_2B_{12}H_{12}/BKNO_3$, lead azide, hexanitrostilbene (HNS), and ammonium perchlorate. Note that material of thermal initiator 109 and booster 205 may be the same. In such embodiments, the material of booster 205 may be more highly compressed, and thus more energetic, than that of thermal initiator 109. In some embodiments, booster 205 may be omitted if thermal initiator 109 is adapted to provide sufficient energy to initiate propellant 209.

As discussed above, upper housing 103 also defines second cavity 207 in which propellant 209 and packing 211 are disposed, such that propellant 209 is proximate booster 205. Propellant 209 may comprise many different energetic materials, such as, gunpowder, black powder, explosive mixtures of ammonium perchlorate, explosive mixtures of perchlorate, explosive mixtures of potassium nitrate, and pyrotechnic compositions. Propellant 209, however, is not limited to these exemplary materials. The particular material selected for propellant 209 will be dependent upon the fluid jet pressure desired, as will be discussed more fully below.

In one embodiment, packing 211 comprises cotton fibers. Note that, while propellant 209 and booster 205 are disposed in separate cavities (i.e., cavities 201, 207) of upper housing 103, the present invention is not so limited. Rather, upper housing 103 may define a single cavity, combining first cavity 201 and second cavity 207, such that booster 205 is in contact with, adjacent, or proximate propellant 209. One purpose for packing 211 is to retain propellant 209 in place proximate booster 205.

Lower housing 105 defines a cavity 213 in which a fluid 215 is disposed. In various embodiments, fluid 215 may comprise, for example, water or a combination of water and alcohol, ethylene glycol, and/or propylene glycol to lower the freezing point of fluid 215. Fluid 215 may also comprise a combination of methyl cellulose, such as methacrylamide, and water. In some such embodiments, fluid 215 may include abrasive particles, such as garnet, alumina, or diamond. Moreover, fluid 215 may comprise ammonia or a combination of water and ammonia. Passage 107 of lower housing 105 is in fluid communication with cavity 213. In the illustrated embodiment, passage 107 is obstructed by a plug 219, which is more clearly shown in FIG. 3. Other embodiments, however, are possible, as will be discussed more fully below. A membrane 221 separates cavity 213 of lower housing 105 and second cavity 207 of upper housing 103. In the illustrated embodiment, membrane 221 and plug 219 retain fluid 215 in cavity 213 of lower housing 105.

Still referring to FIG. 2, one particular operation of fluid jet apparatus 101 will now be described. As discussed above, thermal initiator 109 is adapted to initiate (i.e., deflagrate or detonate) at about a certain temperature or within a range of temperatures. Energy produced by thermal initiator 109 subsequently initiates booster 205, if present, which then initiates propellant 209. Rapidly expanding gases formed during deflagration or detonation of propellant 209 urge packing 211 toward membrane 221 and breach membrane 221. The highly pressurized gases then urge fluid 215 through passage 107, removing all or part of plug 219 and creating a jet of fluid 215 exiting passage 107.

Alternatively, membrane 221 may not be breached upon detonation of propellant 209. In such an embodiment, membrane 221 acts as a piston, such that the pressurized gases urge membrane 221 toward passage 107. Membrane 221, in turn, urges fluid 215 through passage 107 to create fluid jet 215.

Figure 3:
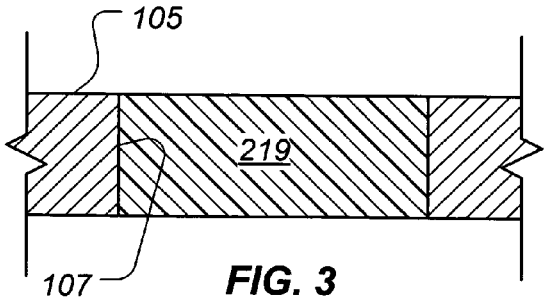
FIGS. 3-5 are enlarged views of a portion of the fluid jet apparatus of FIG. 2 illustrating various embodiments of an output passage of the fluid jet apparatus.
Figure 4:
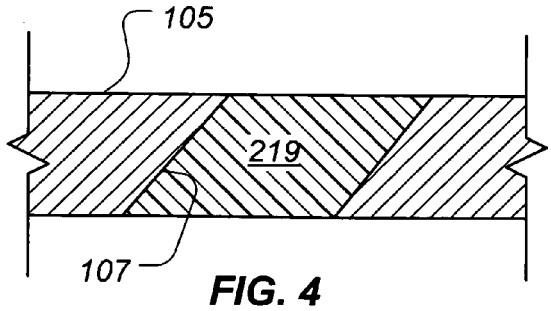
Figure 5:
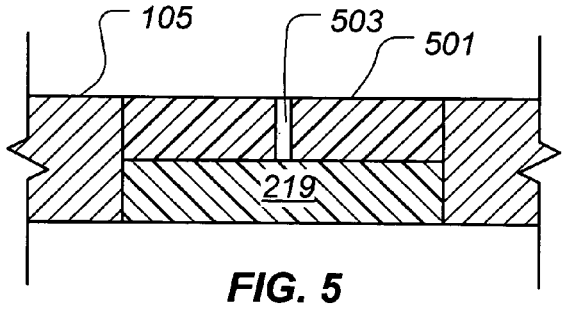

As discussed above, passage 107 may have various configurations depending upon the implementation of fluid jet apparatus 101. For example, as shown in FIG. 3, passage 107 may be right cylindrical in shape, such that the jet of fluid 215 exits normally (i.e., generally perpendicular) from lower housing 105. It may be desirable, however, in certain situations for the jet of fluid 215 to exit from lower housing 105 at an angle other than perpendicular. Accordingly, as shown in FIG. 4, passage 107 may extend through lower housing 105 at an oblique angle. Moreover, in some embodiments, as shown in FIG. 5, a jewel 501 defining an orifice 503 may be disposed in passage 107 to create a smaller, better defined jet of fluid 215. Note that such a smaller, better defined jet of fluid 215 may not be required or even desirable and, thus, the present invention is not so limited. In each of the illustrated embodiments, plug 219 substantially seals passage 107, but other means for sealing passage 107 are within the scope and content of the present invention.

Figure 6:
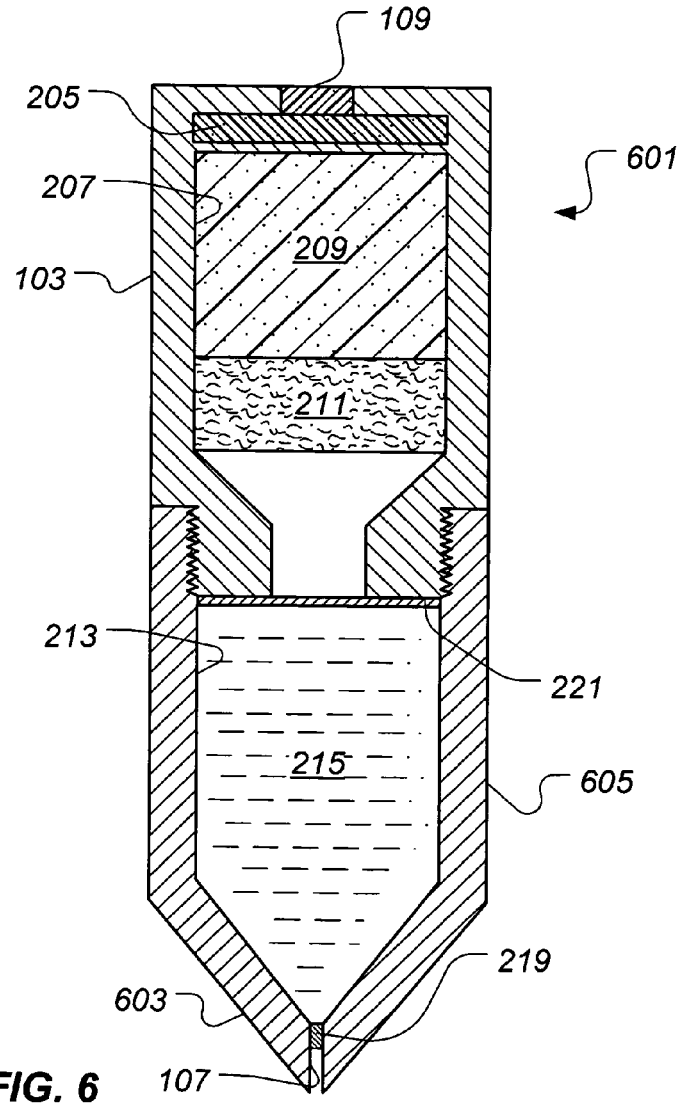
FIG. 6 is an alternative illustrative embodiment of a fluid jet apparatus according to the present invention.

Referring now to FIG. 6, it may be desirable in certain implementations to configure lower housing 105 to better fit within confines in which lower housing 105 is to be used. For example, in the illustrated embodiment, fluid jet apparatus 601 includes a lower portion 603 of lower housing 605 having a generally conical shape. As discussed previously, the scope of the present invention encompasses any suitable configuration of fluid jet apparatus 101, 601 in general and, specifically, any suitable shape of lower housing 105, 603.

Figure 7:
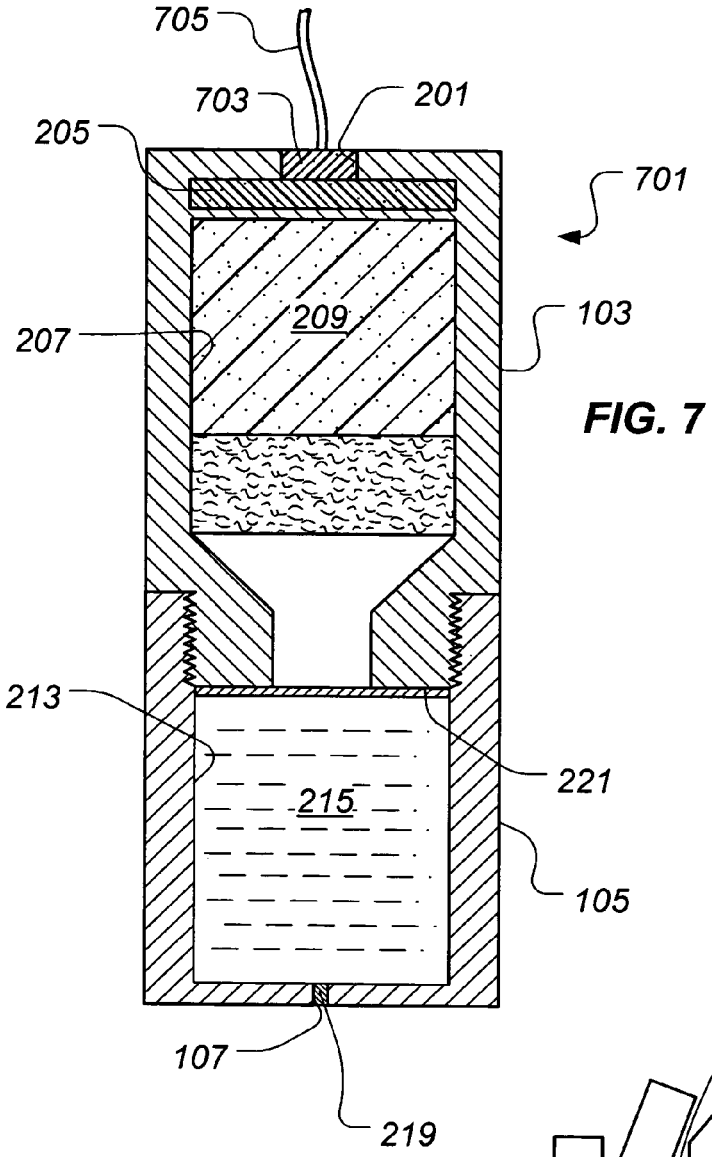
FIG. 7 is an alternative, electrically-activated embodiment of a fluid jet apparatus according to the present invention.

FIG. 7 depicts an illustrative embodiment of fluid jet apparatus 701 that may be, for example, electrically initiated. In this embodiment, an initiator 703 replaces thermal initiator 109 of FIGS. 1A, 2, and 6. An initiation cord 705, such as shielded mild detonating cord or the like, extends from initiator 703 to an activator (not shown), such as a command detonator, timer detonator, remote control detonator, or the like. Note that initiator 703 may comprise exactly the same material as thermal initiator 109, a variant of the material of thermal initiator 109, or a different material, depending upon the type of system used to initiate fluid jet apparatus 101.

Figures 8, 10:
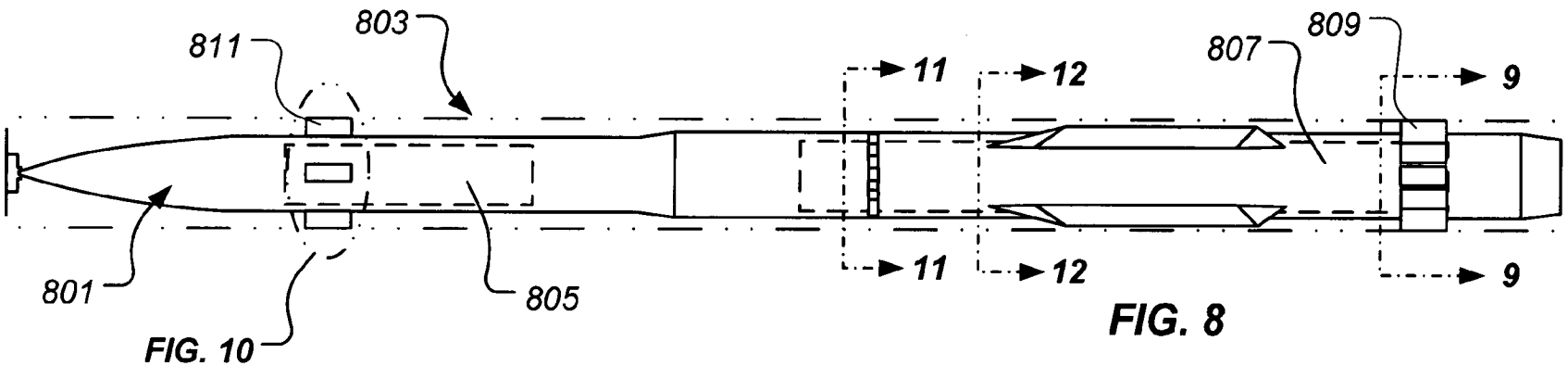
FIG. 8 is a stylized, side view of an exemplary munition disposed in an exemplary canister, which is shown in phantom, all according to the present invention.
FIG. 10 is an enlarged view of a portion of the munition of FIG. 8 illustrating fluid jet apparatuses disposed in forward sabots, all according to the present invention.

FIG. 8 provides a stylized elevational view of a munition 801 disposed within a canister 803 (shown in phantom). Such canisters may be used, for example, to protect munition 801 during shipment or to house munition 801 prior to launch. Disposed within munition 801 are energetic materials, specifically an explosive 805 and a propellant 807. The shapes, forms, and locations of energetic materials 805, 807 illustrated in FIG. 8 are merely exemplary. Energetic materials 805, 807 may take on any number of shapes or forms and be disposed at various locations within munition 801, depending upon the design of munition 801.

As described in more detail below, fluid jet apparatus 101 is adapted to selectively vent munition 801 proximate explosive 805 and/or propellant 807. The venting relieves pressure within munition 801 to inhibit inadvertent detonation of explosive 805 and/or propellant 807.

Figure 9:
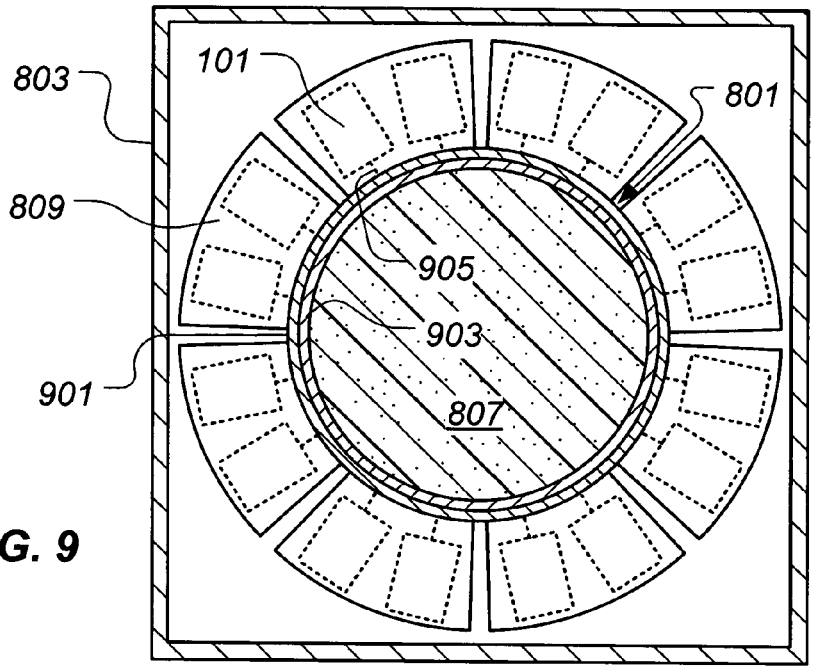
FIG. 9 is a cross-sectional view of the munition of FIG. 8, taken along the line 9-9 of FIG. 8, illustrating fluid jet apparatuses disposed in aft sabots, all according to the present invention.
Figure 10:
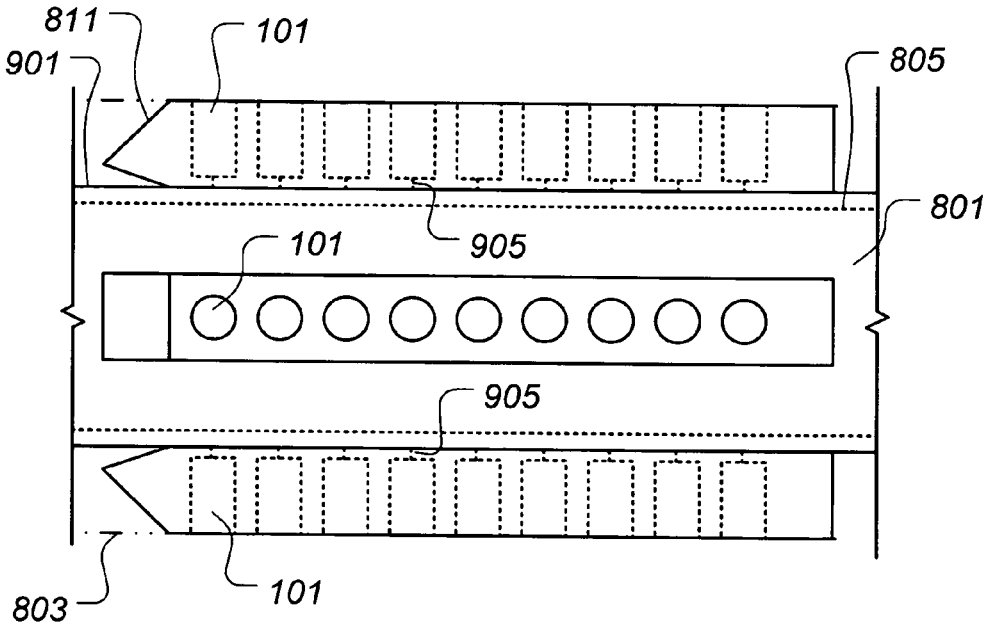

FIG. 9 depicts one particular implementation of fluid jet apparatus 101 to selectively vent munition 801. Note that the view of FIG. 9 is taken along the line 9-9 in FIG. 8 and illustrates munition 801 in cross section. In this particular embodiment, munition 801 comprises propellant 807 disposed within a casing 901. An insulating layer 903 is disposed between propellant 807 and casing 901 in the illustrated embodiment but may be omitted in other embodiments. Note that propellant 807 may comprise any energetic material, such as explosive 805 (shown in FIG. 8). In this implementation, a plurality of fluid jet apparatuses 101 (only one labeled for clarity) is radially disposed around munition 801 in aft sabots 809 (first shown in FIG. 8, only one labeled for clarity). When initiated, fluid jet apparatuses 101 produce jets 905 (only one labeled for clarity) of fluid 215 that are directed toward casing 901 to penetrate and vent casing 901. While the illustrated embodiment provides two fluid jet apparatuses 101 disposed in each aft sabot 809, the present invention is not so limited. Rather, some aft sabots 809 may not include a fluid jet apparatus 101 and some aft sabots 809 may include one or more fluid jet apparatuses 101.

FIG. 10 illustrates another particular implementation of fluid jet apparatus 101 to selectively vent munition 801. In this implementation, a plurality of fluid jet apparatuses 101 (not all labeled for clarity) is disposed in forward sabots 811 (first shown in FIG. 8, only one labeled for clarity) generally along a portion of the length of munition 801 proximate explosive 805. Note that explosive 805 may comprise any energetic material, such as propellant 807 (shown in FIG. 8). When initiated, fluid jet apparatuses 101 produce jets 905 (not all labeled for clarity) of fluid 215 that are directed toward casing 901 to penetrate and vent casing 901. While the illustrated embodiment provides nine fluid jet apparatuses 101 disposed in each forward sabot 811, the present invention is not so limited. Rather, some forward sabots 811 may not include a fluid jet apparatus 101 and some forward sabots 811 may include one or more fluid jet apparatuses 101.

Figure 11:
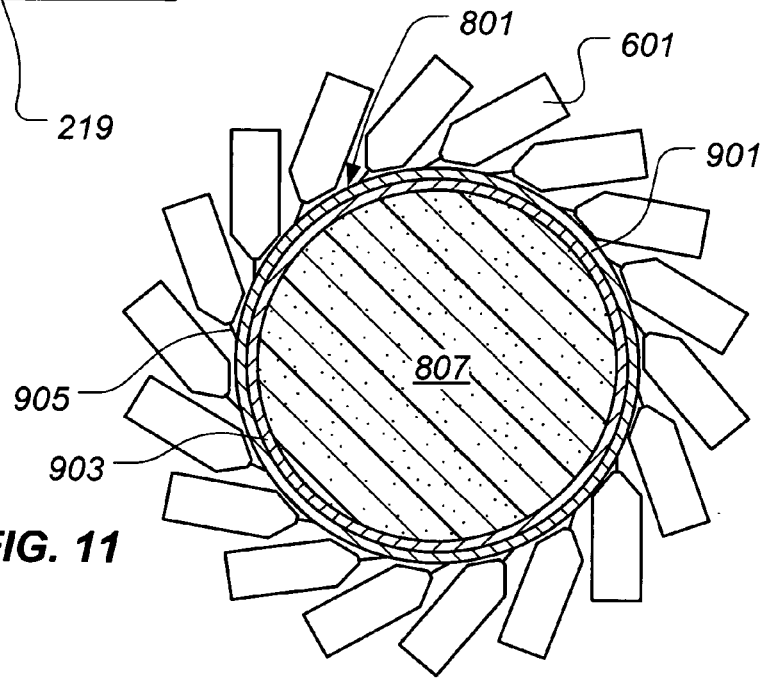
FIG. 11 is a cross-sectional view of the munition of FIG. 8, taken along the line 11-11 in FIG. 8, illustrating an alternative radial arrangement of fluid jet apparatuses about the munition, all according to the present invention.

FIG. 11 depicts an illustrative implementation of the embodiment of fluid jet apparatus 601 shown in FIG. 6. In this implementation, a plurality of fluid jet apparatuses 601 is radially disposed around munition 801. When initiated, fluid jet apparatuses 601 produce jets 905 that impinge upon casing 901 at an oblique angle to produce slotted perforations of casing 901. Such slotted perforations may provide greater venting in certain implementations than non-slotted perforations. Note that, while the implementation depicted in FIG. 11 provides a certain number (i.e., 18) fluid jet apparatuses 601 disposed around munition 801, the present invention is not so limited. Rather, any suitable number of fluid jet apparatuses 601 may be disposed around munition 801. Moreover, in some embodiments, only one fluid jet apparatus 601 may be disposed proximate munition 801. In some embodiments, fluid jet apparatus may be disposed in or on munition 801.

Figure 12:
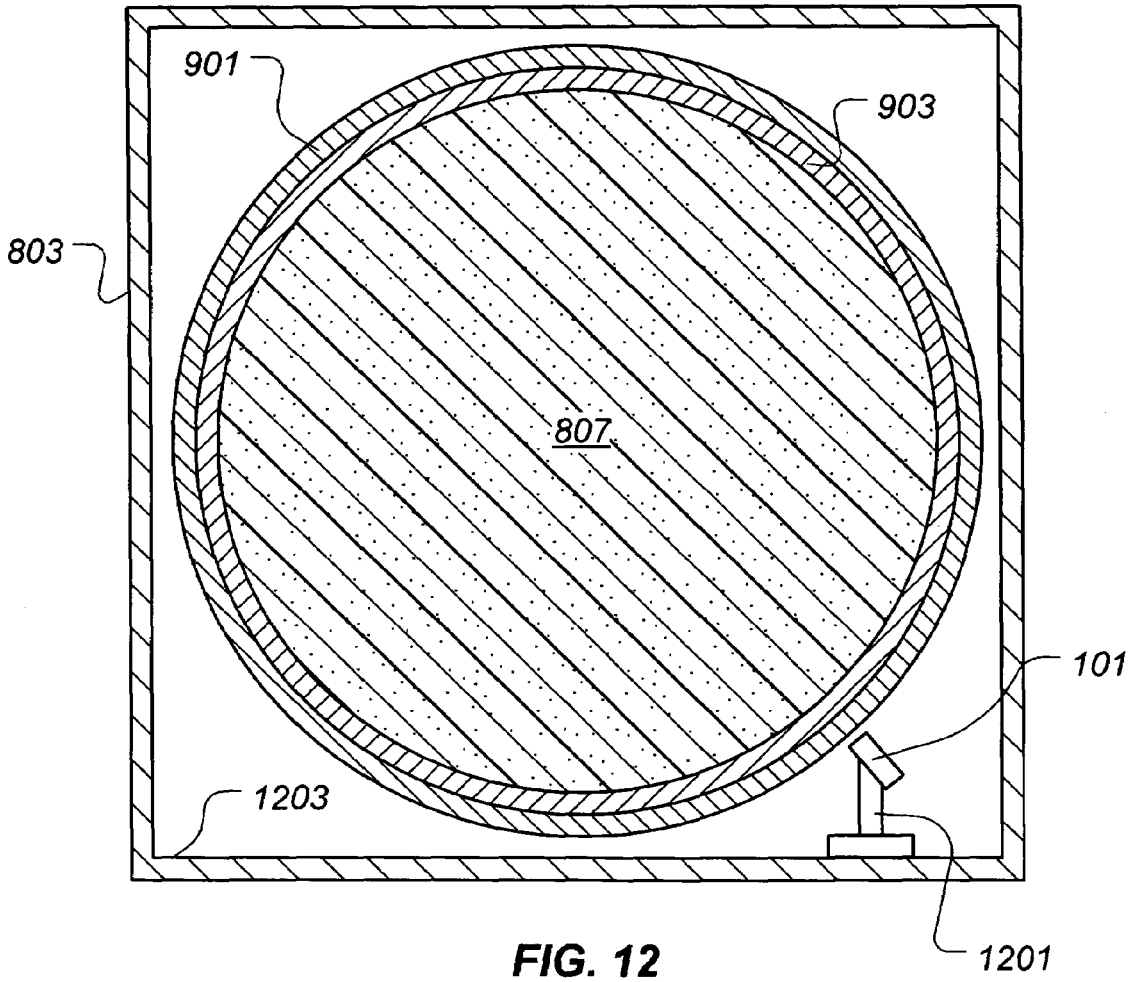
FIG. 12 is a cross-sectional view of the munition of FIG. 8, taken along the line 12-12 in FIG. 8, illustrating a fluid jet apparatus mounted via a bracket to a canister housing the munition, all according to the present invention.

One or more fluid jet apparatuses 101 may, alternatively, be attached to canister 803 instead of or in addition to being disposed in or on munition 801 or in sabots 809, 811. In this particular embodiment, shown in FIG. 12, fluid jet apparatus 101 is disposed in or on a bracket 1201 extending from inner surface 1203 of canister 803. Note that, while only one bracket 1201 and fluid jet apparatus 101 are shown in FIG. 12, the scope of the present invention includes embodiments wherein a plurality of brackets 1201 and fluid jet apparatuses 101 are included therein. Moreover, a plurality of fluid jet apparatuses 101 may be disposed in or on a single bracket 1201.

Note that any embodiment of fluid jet apparatus 101 may be used in any implementation within the scope of the present invention. For example, thermally-initiated fluid jet apparatus 101 (shown in at least FIG. 2) or electrically-initiated fluid jet apparatus 701 (shown in at least FIG. 7) may be used in any of the implementations shown in FIGS. 9-12. Moreover, any configuration of fluid jet apparatus 101, such as fluid jet apparatus 601 of FIG. 6, may be used in any of the implementations shown in FIGS. 9-12. It should also be noted that means for activating fluid jet apparatus 101 other than thermal and electrical means are also within the scope and content of the present invention. Such means for activating fluid jet apparatus 101 include means for activating that one of ordinary skill in the art would appreciate having the benefit of the present application. Also, note that the present invention may be used with other initiating means and/or venting means. For example, the present invention may be initiated via a separate thermal, electrical, or impact initiator. Moreover, the present invention may be used in conjunction with one or more cutting charges, such as linear shaped charges, initiated by the present invention or by a separate initiator.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A munition system, comprising:

a munition; and at least one fluid jet apparatus external to said munition and adapted to vent the munition, the at least one fluid jet apparatus comprising:

a housing defining a propellant cavity, a fluid cavity, and a passage through the housing in fluid communication with the fluid cavity;

a breachable membrane separating the propellant cavity and the fluid cavity; a propellant disposed in the propellant cavity; and a fluid retained in the fluid cavity, wherein the propellant urges the fluid from the fluid cavity through the passage upon initiation of the propellant.

2. The munition system according to claim 1, further comprising:

an initiator for initiating the propellant.

3. The munition system according to claim 2, wherein the initiator is an electrical initiator.

4. The munition system according to claim 2, wherein the initiator is a thermal initiator.

5. The munition system according to claim 2, wherein the initiator comprises:

at least one of $Cs_2B_{12}H_{12}/BKNO_3$, lead azide, hexanitrostilbene (HNS), and ammonium perchlorate.

6. The munition system according to claim 2, further comprising:

a booster disposed between the initiator and the propellant.

7. The munition system according to claim 6, wherein the booster is more energetic than the initiator and comprises:

at least one of $Cs_2B_{12}H_{12}/BKNO_3$, lead azide, hexanitrostilbene (HNS), and ammonium perchlorate.

8. The munition system according to claim 1, wherein the passage extends obliquely through the housing.

9. The munition system according to claim 1, wherein the passage extends normally through the housing.

10. The munition system according to claim 1, wherein the propellant comprises:

at least one of gunpowder, black powder, an explosive mixture of ammonium perchlorate, an explosive mixture of perchlorate, an explosive mixture of potassium nitrate, and a pyrotechnic composition.

11. The munition system according to claim 1, wherein the fluid comprises:

at least one of water, a combination of water and alcohol, a combination of water and ethylene glycol, a combination of water and propylene glycol, a combination of water and methyl cellulose, a combination of water and methacrylamide, ammonia, and a combination of water and ammonia.

12. The munition system according to claim 1, wherein the fluid includes abrasive particles.

13. The munition system according to claim 1, further comprising:

a jewel disposed in the passage and defining an orifice therethrough.

14. The munition system according to claim 1, wherein the passage is a slot.

15. The munition system according to claim 1, wherein the at least one includes a plurality of fluid jet apparatuses operably associated with the munition.

16. The munition system according to claim 1, wherein the at least one includes a plurality of fluid jet apparatuses disposed generally along a length of the munition.

17. The munition system according to claim 1, wherein the at least one fluid jet apparatus is adapted to produce a slot in the munition when the fluid jet apparatus is activated.

18. The munition system according to claim 1, wherein the at least one fluid jet apparatus is disposed relative to the munition such that a fluid jet produced by the fluid jet apparatus impinges the munition at an oblique angle when the fluid jet apparatus is activated.

19. The munition system according to claim 1, further comprising:

a sabot in which the fluid jet apparatus is disposed.

* * * * *

UNITED STATES PATENT AND TRADEMARK OFFICE

CERTIFICATE OF CORRECTION

PATENT NO. : 7,387,072 B2
APPLICATION NO. : 11/128580
DATED : June 17, 2008
INVENTOR(S) : David L. Hunn, Ben T. Milam and Kenneth W. Havens It is certified that error appears in the above-identified patent and that said Letters Patent is hereby corrected as shown below:

In column 8, line 65, cancel the text beginning with "15. The munition system" to and ending with "the munition." in column 8, line 67, and insert the following claim:

15. The munition system according to claim 1, wherein the at least one fluid jet apparatus includes a plurality of fluid jet apparatuses operably associated with the munition.

In column 9, line 1, cancel the text beginning with "16. The munition system" to and ending with "the munition." in column 9, line 3, and insert the following claim:

16. The munition system according to claim 1, wherein the at least one fluid jet apparatus includes a plurality of fluid jet apparatuses disposed generally along a length of the munition.

Signed and Sealed this

Twenty-sixth Day of August, 2008

JON W. DUDAS
*Director of the United States Patent and Trademark Office*